US005672452A

United States Patent [19]

Kanbayashi et al.

[11] Patent Number: 5,672,452

[45] Date of Patent: Sep. 30, 1997

[54] METHOD FOR TRANSFERRING COLOR IMAGES ONTO BOTH SIDES OF A TRANSFER MATERIAL

[75] Inventors: Makoto Kanbayashi, Kawasaki; Takashige Kasuya, Soka; Tatsuya Nakamura; Tatsuhiko Chiba, both of Tokyo; Koji Inaba, Yokohama, all of Japan

[73] Assignee: Canon Kabushiki Kaisha, Tokyo, Japan

[21] Appl. No.: 500,015

[22] Filed: Jul. 10, 1995

Related U.S. Application Data

[63] Continuation of Ser. No. 74,417, Jun. 10, 1993, abandoned.

[30] Foreign Application Priority Data

Jun. 15, 1992 [JP] Japan ..... 5-178900

[51] Int. Cl.[6] ..... G03G 13/01

[52] U.S. Cl. ..... 430/47; 430/45

[58] Field of Search ..... 430/47, 45, 54

[56] References Cited

U.S. PATENT DOCUMENTS

| | | | |
|---|---|---|---|
| 4,626,490 | 12/1986 | Yamazaki et al. | 430/138 |
| 5,104,763 | 4/1992 | Ong et al. | 430/109 |
| 5,143,812 | 9/1992 | Mori et al. | 430/99 |
| 5,159,392 | 10/1992 | Kasahara et al. | 355/274 |
| 5,164,782 | 11/1992 | Nagayama et al. | 430/124 |
| 5,281,504 | 1/1994 | Kanbayashi et al. | 430/99 |

FOREIGN PATENT DOCUMENTS

| | | |
|---|---|---|
| 0470479 | 2/1992 | European Pat. Off. . |
| 3519242 | 12/1985 | Germany . |

*Primary Examiner*—George F. Lesmes
*Assistant Examiner*—Laura Werner
*Attorney, Agent, or Firm*—Fitzpatrick, Cella, Harper & Scinto

[57] ABSTRACT

An image-forming method is disclosed. A color toner image formed on an electrostatic latent image carrier is transferred onto one surface of a transfer material and fixed on the transfer material by a fixing means through heating and melting. An other color toner image formed on the electrostatic latent image carrier is transferred onto an other surface opposite to the color toner-fixed surface of the transfer material and fixed, thereby forming color images fixed on both surfaces of the transfer material. The color toner forming the color images contains toner particles directly obtained by suspension polymerization, and the toner particles contain wax.

30 Claims, 3 Drawing Sheets

METHOD FOR TRANSFERRING COLOR IMAGES ONTO BOTH SIDES OF A TRANSFER MATERIAL

This application is a continuation of application Ser. No. 08/074,417 filed Jun. 10, 1993, now abandoned.

BACKGROUND OF THE INVENTION

1. Field of the Invention

The present invention relates to an image-forming process for forming a color toner image, particularly a full color toner image by electrophotography, and particularly to an image-forming process for forming a color image fixed on both sides of a transfer material.

2. Related Background Art

A process for forming a full color image will be generally described below. A photosensitive member of a photosensitive drum as an electrostatic latent image carrier is uniformly electrostatically charged by a primary electrostatic charger, and an image light exposure is carried out thereon by a laser beam modulated by magenta image signals of an original to form an electrostatic image on the photosensitive drum. The electrostatic image is developed by a magenta developer containing magenta toners to form a magenta toner image. Then, the magenta toner image developed on the photosensitive drum is transferred onto a conveyed transfer material by a transfer electrostatic charger.

The photosensitive drum after the development of the electrostatic latent image is deelectrified by a deelectrifying charger and cleaned by a cleaning means, and then electrostatically charged by the primary electrostatic charger. Then, formation of a cyan toner image and transfer of the cyan toner onto the transfer material having the transferred magenta toner image are carried out likewise. Then, the similar procedures are carried out with yellow color and black color successively to transfer toner images of four colors onto the transfer material.

The transfer material with the toner images of four colors is fixed under actions of heat and pressure by fixing rollers to form a full color image.

Toners for use in the color image-forming process are required to have good meltability and color blendability when heated. It is preferable to use toners having a low softening point, a low melt viscosity and a sharp meltability.

A color reproduction range of a copy can be broadened and a color copy can be obtained exactly according to an original image by using such sharp meltable toners. However, such sharp meltable color toners have a good affinity to fixing rollers and thus is highly susceptible to offsetting on the fixing rollers during the fixation. Particularly in a fixing means in the color image-forming apparatus, a plurality of toner layers, such as magenta, cyan, yellow and black layers, are formed on a transfer material, and thus the offsetting is highly liable to occur.

In the conventional art of improving the releasability of toners from fixing rollers a releasing agent such as silicone oil has been applied to the fixing rollers. However, such conventional image-forming process has the following inconvenience. The conventional fixing system of applying a releasing agent such as oil to the rollers not only complicates the structure of the electrophotographic apparatus itself, but also has such a problem that the application of a releasing agent such as oil accelerates to shorten the duration of the fixing rollers.

Furthermore, to meet recent increasing needs for various modes of copying and also to reduce paper consumption as a result of recent increasing ecological considerations, a demand for an image-forming process for forming images on both sides of a transfer material, that is, the both side-copying, has been intensified day after day.

In the conventional fixing system of applying a releasing agent such as oil to fixing rollers as described above, there has been such an inconvience that a portion of toners for the second fixing is highly susceptible to offsetting onto the image of first fixing at the second fixing under these situations, and it has been keenly expected to improve a fixing system and develop toners having a higher offset resistance.

An example of the conventional image-forming apparatus is an electrophotographic apparatus for forming a color image, shown in FIG. 3, which will be briefly explained below.

A color electrophotographic apparatus as shown in FIG. 3 is largely divided into a transfer material conveyer system I provided from the right side of the apparatus proper 1 (right side of FIG. 3) over approximately to the center part of the apparatus proper 1, a latent image-forming section II provided in close proximity to a transfer drum 15 constituting the transfer material conveyer system I and a developing means provided in close proximity to the latent image-forming section II, that is, a rotary developing unit III.

The transfer material conveyer system I is in the following structure. Openings are formed on the right wall of the apparatus proper 1 (right side of FIG. 3), and detachable transfer material feed trays 2 and 3 are provided into the openings, respectively, while being projected outwardly from the apparatus. Paper feed rollers 4 and 5 are provided just above the trays 2 and 3, respectively, and paper feed rollers 6 and paper feed guides 7 and 8 are provided so as to communicate the paper feed rollers 4 and 5 with a transfer drum 15, i.e. a transfer means rotatable in the direction of arrow A, provided on the left side. A contact roller 9, a gripper 10, a transfer material-separating charger 11 and a separator knife 12 are successively provided in close proximity to the outer peripheral surface of the transfer drum 15 from the upstream side toward the downstream side in the rotating direction. A transfer charger 13 and a transfer material-separating charger 14 are provided in close proximity to the inner peripheral surface of the transfer drum 15. A transfer sheet formed from a material such as polyvinylidene fluoride (not shown in the drawing) is pasted onto the part, around which a transfer material is wound, of the transfer drum 15, and the transfer material is electrostatically closely pasted onto the transfer sheet. A conveyer belt means 16 is provided in close proximity to the separator knife 12 above and the right side of the transfer drum 15, and a fixing unit 18 is provided at the right end of the conveyer belt means 16 in the transfer material conveying direction. A detachable discharge tray 17 is provided on a further downstream side in the conveying direction from the fixing unit 18 and at the apparatus proper 1, while being projected outwardly from the apparatus proper 1.

The structure of the latent image-forming section II will be explained below. A photosensitive drum 19 as a latent image carrier rotatable in the direction of arrow B in FIG. 3 is provided in contact with the outer peripheral surface of the transfer drum 15. A deelectrifying charger 20, a cleaning means 21 and a primary electrostatic charger 23 are successively provided above the photosensitive drum 19 and in close proximity to the outer peripheral surface thereof from the upstream side toward the downstream side in the rotating direction of the photosensitive drum 19, and an image light exposure means 24 such as a laser beam scanner and an image light exposure-reflecting means 25 such as a mirror are provided to form an electrostatic latent image on the outer peripheral surface of the photosensitive drum 19.

The structure of the rotary developing unit III will be explained below. A rotatable box 26, which will be hereinafter referred to as a rotor, is provided at a position opposite to the outer peripheral surface of the photosensitive drum 19, and 4 developing units are loaded at 4 positions in the peripheral direction in the rotor 26 to visualize the electrostatic latent image formed on the outer peripheral surface of the photosensitive drum 19, that is, to develop the latent image. The 4 developing units are a yellow developing unit 27Y, a magenta developing unit 27M, a cyan developing unit 27C and a black developing unit 27BK, respectively.

Sequence of the entire image-forming apparatus in the above-mentioned structure will be simply explained below, referring to a case of full color mode as an example. When the photosensitive drum 19 rotates in the direction of arrow B in FIG. 3, the photosensitive member on the photosensitive drum 19 is uniformly electrostatically charged by the primary electrostatic charger 23. In the apparatus of FIG. 3, the moving speeds of the respective parts (which will be hereinafter referred to as "process speeds") are uniformly 160 mm/sec. After the uniform electrostatic charging by the primary electrostatic charger 23, image light exposure is carried out by a laser beam E modulated by yellow image signals of original 28 and an electrostatic image is formed on the photosensitive drum 19. The electrostatic image is developed by the yellow developing unit 27Y located at the developing position in advance through rotation of the rotor 26.

Transfer material conveyed through the paper feed guide 7, the paper feed roller 6 and the paper feed guide 8 is held by the gripper 10 at a predetermined timing and electrostatically wound around the transfer drum 15 by the contact roller 9 and an electrode provided opposite to the contact roller 9. The transfer drum 15 rotates in the direction of arrow A in FIG. 3 in a manner synchronized with the photosensitive drum 19, and the image developed and visualized by the yellow developing unit 27Y is transferred at the contact site of the outer peripheral surface of the photosensitive drum 19 with the outer peripheral surface of the transfer drum 15 by the transfer charger 13. The transfer drum continuously rotates as such to make ready for the transfer of successive color (magenta in FIG. 3).

The photosensitive drum 19 is deelectrified by the deelectrifying charger 20, cleaned by the cleaning means 21 based on a known blade cleaning, then again electrostatically charged by the primary electrostatic charger 23 and subjected to an image light exposure of next magenta image signals in the same manner as above. The rotary developing unit is rotated during the formation of an electrostatic image by magenta image signals on the photosensitive drum 19 through the image light exposure, thereby locating the magenta developing unit 27 to the above-mentioned predetermined developing position to conduct the desired magenta development. Successively the similar processes are carried out for cyan color and black color. After completion of the transfer of 4 colors, the visualized image of 4 colors on the transfer material is deelectrified by the respective chargers 20 and 14, and the transfer material is then released from holding by the gripper 10, separated from the transfer drum 15 by the separator knife 12, sent to the fixing unit 18 by the conveyer belt 16 and subjected to fixing under actions of heat and pressure to complete a series of full color print sequence, thereby forming a desired full color print image.

In FIG. 4, the fixing roller 29 as a fixing means comprises, for example, an aluminum core 31, a silicone rubber layer 32 of HTV (high temperature vulcanization type) laid thereon, and a silicone rubber layer 33 of RTV (room temperature vulcanization type) laid thereon, 3 mm in total layer thickness and 60 mm in diameter. The pressing roller 30 as a pressing means comprises, for example, an aluminum core 34, a silicon rubber layer 47 of HTV type having a thickness of 1 mm thereon and a silicone rubber layer 35 of RTV type thereon, 60 mm in diameter.

A halogen heater 36 is provided as a heating means in the fixing roller 29 and also a halogen heater 37 is likewise provided in the core of the pressing roller 30 to conduct heating to both sides. Temperature of the pressing roller is detected by a thermister 38 in contact with the pressing roller 30, and the halogen heaters 36 and 37 are controlled by a control system or controller 39 on the basis of the detected temperature. That is, the temperatures of the fixing roller 29 and the pressing roller 30 are both controlled constantly to about 170° C. The fixing roller 29 and the pressing roller 30 are pressed under a total pressure of about 40 kg by a pressing mechanism (not shown in the drawing).

In FIG. 4, "O" is an oil applicator as a means of applying a releasing agent, "C" a cleaning unit and "Cl" a cleaning blade for removing oil and foulings from the pressing roller. The oil applicator O is to apply a controlled amount of oil, i.e. dimethylsilicone oil 41 (KF96; viscosity: 300 cs, trade mark of a product made by Shinetsu Kagaku K.K., Japan) to the fixing roller 29 by an application amount-controlling blade 44 from an oil pan 40 through an oil pickup roller 42 and an oil applicator roller 43. The cleaning unit C is to conduct cleaning by pressing a web 46 of non-woven fabric made from Nomex (trademark, supplied by E. I. du Pont de Nemours & Co.) onto the fixing roller 29 by the pressing roller 45. The web 46 is properly wound up by a winder (not shown in the drawing) to avoid accumulation of toners at the contact part.

The electrophotographic apparatus for forming a color image as described above is to form a visualized image only on one side of the transfer material. An apparatus capable of forming the visualized image on both surface side and back side of a transfer material has been already proposed.

In case of conducting both-side copying of color images, the toner image developed by a developing means is transferred onto a transfer material at the transfer part by a transfer means, and the unfixed toner image on the transfer material is fixed by a fixing means and then the transfer material is withdrawn.

The withdrawn transfer material is successively conveyed again to the transfer part in such a state that the surface side and the back side are reversed, and another toner image developed by the developing means is transferred onto the other side, i.e. the side opposite to the toner image-fixed side, of the transfer material, and the unfixed toner image on the other side of the transfer material is fixed by the fixing means, thereby conducting both-side color copying.

However, the above-mentioned both-side color copying suffers from the following inconvenience.

By conducting the first heat fixation onto the surface of a transfer material after the completion of the initial image formation operation, oil as a releasing agent is attached to the toners and the transfer material. When such transfer material is fed again for both side copying, the first toner-fixed surface, that is, the oil-attached surface will face the outer peripheral surface of transfer drum 15. Thus, the oil attached to the toners and the transfer material is transported onto the transfer sheet by winding of the transfer material around the transfer drum 15, and the oil on the transfer drum 15 is transported onto the photosensitive drum 19 by rotation of the transfer drum 15 after separation of the transfer material from the transfer drum 15.

When the oil is transported onto the photosensitive drum 19 in that manner, the toners on the photosensitive drum 19 cannot be cleaned off even by the cleaning unit C, or toners are attached to the oil at other parts than the desired latent image formation parts. Thus, a fouled image with excessive toner deposition is ultimately produced in the successive copying. This has been a problem.

SUMMARY OF THE INVENTION

An object of the present invention is to provide an image-forming method free from the above-mentioned problem.

Another object of the present invention is to provide an image-forming method for obtaining a both-side color toner image having a good offset resistance without using oil in a fixing means during the fixing or with a smaller amount of oil, where image deterioration due to transportation of oil onto the surface of latent image carrier is prevented or suppressed.

The present invention provides an image-forming method which comprises transferring a color toner image formed on an electrostatic latent image carrier onto one surface of a transfer material, fixing the color toner image on the transfer material by a fixing means through heating and melting, transferring an other color toner image formed on the electrostatic latent image carrier onto an other surface opposite to the color toner-fixed surface of the transfer material, and fixing the color toner on the other surface of the transfer material by the fixing means through heating and melting, thereby forming color images fixed on both surfaces of the transfer material, wherein the color toner forming the color images contains toner particles directly obtained by suspension polymerization and the toner particles contain wax.

DETAILED DESCRIPTION OF THE PREFERRED EMBODIMENTS

Figure 1:
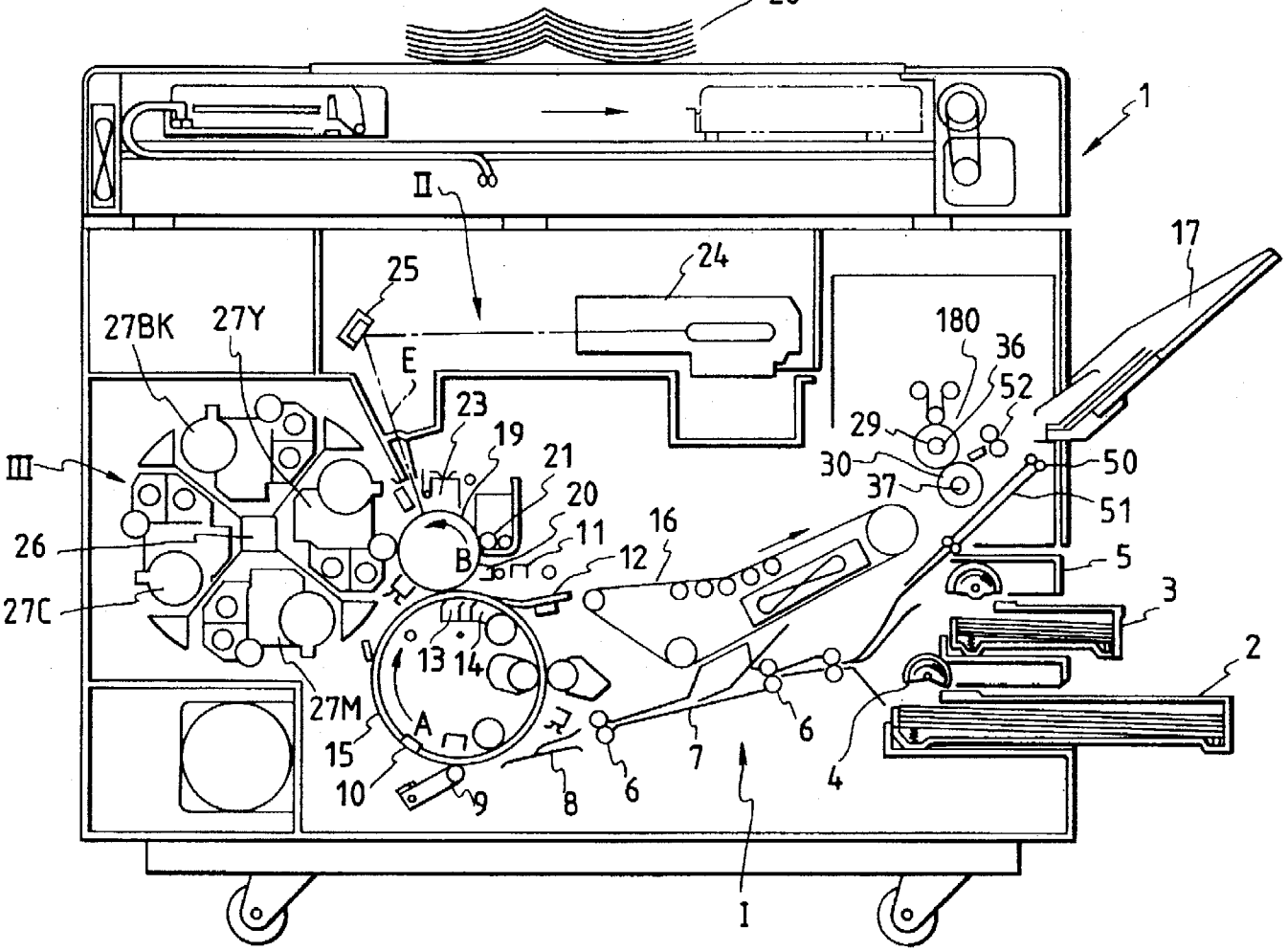
FIG. 1 is a schematic view showing the structure of an image-forming apparatus capable of conducting both-side fixing.

Color toners for use in the present invention are toner particles directly obtained by suspension polymerization. In the suspension polymerization, polymerizable monomers and a coloring agent, and, if necessary, a polymerization initiator, a cross-linking agent, a charge-controlling agent and other additives are subjected to uniform dissolution or dispersion to obtain a monomer composition and then the monomer composition is dispersed into a continuous phase, for example, an aqueous phase, containing a dispersion stabilizer by an appropriate stirrer, and is subjected to polymerization reaction at the same time, whereby toner particles having a desired particle size can be obtained.

In the suspension polymerization, liquid droplets of the monomer composition are formed in water, i.e. a dispersion medium having a large polarity, and thus components having polar groups contained in the monomer composition are liable to exist in the surface layer region at the boundary with the water phase. That is, no non-polar components, such as wax, exist in the surface layer region, and the so called capsule structure can be obtained. It is possible on the basis of the features of the suspension polymerization to add a low melting wax that can be never employed in other methods, for example, pulverization method.

The toners obtained by the suspension polymerization are in such a capsule structure that wax is contained in the toner particles, as mentioned above, and thus a large amount of low melting wax can be contained therein without deteriorating the blocking resistance and such a large amount of wax melted out of the inside of the toners by heat and pressure applied at the fixing, when the toners are heated and melted, can be effectively utilized as a releasing agent. That is, it is possible to prevent high temperature offsetting during the fixing without applying a releasing agent, such as oil, to the fixing roller.

When such toners are applied to an image-forming method for both-side fixing, it is possible to conduct even the second fixing fully without applying oil to the fixing roller.

That is, the wax dispersed in the toner layer on the transfer material is oozed from the inside of toners by heat and pressure when the toners are heated and melted during passage over the fixing roller, whereby the oozed wax covers the image surface fully or partly. When an unfixed image is formed on the other side of the transfer material and the transfer material is passed again over the fixing roller to fix the unfixed image, the wax covering the fixed image, which has been fixed by the first fixing, can work effectively for the second fixing without any trouble.

As explained above, in the fixing system requiring an oil application, the once fixed image, i.e. the image fixed by the first fixing, is fed again for the second image formation, where the toner side fixed by the first fixing, that is, the oil-attached side, of the transfer material is faced to the transfer drum and is wound around the transfer drum, and thus the oil attached to the fixed image is fully or partly transported onto the transfer sheet and further to the photosensitive drum, such troubles are inevitable in the conventional fixing system. In the present invention, on the other hand, the wax oozed from the inside of the toners during the fixing acts as a releasing agent, as explained above, and then is instantaneously solidified by temperature decrease after the passage over the fixing roller. Thus, the troubles of the conventional fixing system can be largely reduced. That is, the wax contained in the toners is highly crystalline wax such as paraffin, and thus is solidified by temperature decrease after the passage over the fixing roller, and the transfer drum fouling level can be considerably lowered, as compared with the conventional oil.

Toner particles (polymer toners), directly obtained by suspension polymerization, for use in the present invention will be explained in detail below.

Additives such as a releasing agent, a coloring agent, a charge-controlling agent, etc. are added to a polymerizable monomer, and the resulting mixture is heated until the releasing agent is dissolved or melted, and subjected to uniform dissolution or dispersion by a mixer such as a homogenizer or an ultrasonic disperser to obtain a monomer system. The resulting monomer system is then dispersed into an aqueous phase containing a dispersion stabilizer at the same temperature as that of the monomer system by a homomixer or a homogenizer.

Stirring speed and time are so adjusted that liquid droplets of monomer can preferably have desired size of toner particles, usually particle size of not more than 30 μm. Thereafter, stirring can be continued to such a degree that the particle state can be maintained and setting of the particles can be prevented by the function of the dispersion stabilizer. The polymerization temperature is set to a lower temperature than the precipitation temperature of the releasing agent. Then, a polymerization initiator is added thereto to start polymerization. After the end of polymerization reaction, the thus formed toner particles are washed, recovered by filtration and dried. In the suspension polymerization, it is usually preferable to use 300 to 3,000 parts by weight of water as a dispersion medium per 100 parts by weight of the monomer system.

Polymerizable monomers for use in the above-mentioned polymer toners include, for example, styrenic monomers such as styrene, o-methylstyrene, m-methylstyrene, p-methylstyrene, p-methoxystyrene, and p-ethylstyrene; acrylate esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylate esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and other monomers such as acrylonitrile, methacrylonitrile, and acrylamide. These monomers can be used alone or in mixture thereof. Among the above-mentioned monomers, it is preferable from the viewpoints of developing characteristics and durability to use styrene or styrene derivatives alone or in mixture with other monomers.

The dispersion medium for use in the present invention is an aqueous phase containing an appropriate dispersion stabilizer in a dispersion state, such as polyvinyl alcohol, gelatin, methyl cellulose, methylhydroxypropyl cellulose, ethyl cellulose, sodium salt of carboxymethyl cellulose, polyacrylic acid and its salts, starch, tricalcium phosphate, aluminum hydroxide, magnesium hydroxide, calcium metasilicate, barium sulfate, and bentonite. It is preferable to use 0.2 to 20 parts by weight of the dispersion stabilizer per 100 parts by weight of the polymerizable monomer.

To finely disperse the dispersion stabilizer, 0.001 to 0.1 parts by weight of a surfactant can be used. The surfactant is to promote the desired action of the dispersion stabilizer, and includes, for example, sodium dodecylbenzenesulfate, sodium tetradecylsulfate, sodium pentadecylsulfate, sodium octylsulfate, sodium oleate, sodium laurate, potassium stearate and calcium oleate.

It is more preferable to carry out polymerization by adding a polymer or copolymer having polar groups as an additive to the monomer system. It is further preferable to carry out polymerization by suspending the monomer system containing the polymer or copolymer having polar groups, or cyclized rubber in an aqueous phase containing a dispersant having a counter chargeability to that of the polar polymer or copolymer in a dispersion state. That is, the cationic or anionic polymer or copolymer or cyclized rubber contained in the monomer system electrostatically attracts the anionic or cationic dispersant having an opposite chargeability dispersed in the aqueous phase on the surfaces of particles to be made into toners in the course of polymerization, thereby covering the surfaces of particles with the dispersant, preventing the particles themselves from coagulation and stabilizing the particles. The added polar polymer or copolymer is gathered in the surface layer regions of particles to be made into toners, thereby forming a kind of shell structure, that is, making the resulting particles into a pseudo-capsule form. By using a polar polymer or copolymer or cyclized rubber having a relatively high molecular weight, thereby giving a high blocking property and a high attrition resistance at the development to toner particles on one hand, and by carrying out polymerization, thereby improving the fixing characteristics with a relative low molecular weight at the inside on the other hand, toners capable of satisfying such contradicting requirements as a good fixability and a high blocking property can be obtained.

Polar polymers and copolymers, and dispersants having a counter chargeability for use in the present invention will be explained below.

(1) Cationic polymers include, for example, polymers of such nitrogen-containing monomers as dimethyl-aminoethyl methacrylate and diethylaminoethyl methacrylate, and copolymer of styrene-unsaturated carboxylic acid ester.

(2) Anionic polymers include, for example, polymers of such monomers as nitrile monomers, for example, acrylonitrile; halogen-containing monomers, for example, vinyl chloride; unsaturated carboxylic acids, for example, acrylic acid and methacrylic acid; and unsaturated dibasic acid, unsaturated dibasic acid anhydride, and nitro-based monomers, and copolymers with styrenic monomers. Cyclized rubber can be used in place of the polar polymers and copolymers.

(3) Anionic dispersants are preferably fine silica powder, particularly colloidal silica having a BET specific surface area of 200 $m^2/g$ or more.

(4) Cationic dispersants include, for example, hydrophilic fine silica powder of positive chargeability such as aminoalkyl-modified colloidal silica having a BET surface area of preferably 200 $m^2/g$ or more, and aluminum hydroxide.

It is preferable to use 0.2 to 20 parts by weight, particularly 0.3 to 15 parts by weight, of the dispersant per 100 parts by weight of the polymerizable monomer.

In the present invention, it is desirable to add a charge-controlling agent to the toner materials to control the chargeability of toners. For this purpose, known charge-controlling agents without substantial inhibition against polymerization and transferability into the aqueous phase can be used.

Positive charge-controlling agents include, for example, nigrosine dyes, triphenylmethane dyes, quaternary ammonium salts, and amine and polyamine compounds. Negative charge-controlling agents include, for example, metal-containing salicylic acid compounds, metal-containing monoazo compounds, styrene-acrylic acid copolymer, and styrene-methacrylic acid copolymer.

Known coloring agents can be used in the present invention and include, for example, carbon black and iron black, such dyes as C.I. Direct Red 1, C.I. Direct Red 4, C.I. Acid Red 1, C.I. Basic Red 1, C.I. Mordant Red 30, C.I. Direct Blue-1, C.I. Direct Blue-2, C.I. Acid Blue-9, C.I. Acid Blue-15, C.I. Basic Blue-3, C.I. Basic Blue-5, C.I. Mordant Blue-7, C.I. Direct Green 6, C.I. Basic Green 4 and C.I. Basic Green 6; and such pigments as Chrome Yellow, Cadmium Yellow, Mineral Fast Yellow, Navel Yellow, Naphthol Yellow S, Hanza Yellow G, Permanent Yellow NCG, Tartrazine Lake, Molybden Orange, Permanent Orange GTR, Benzidine Orange G, Cadmium Red, Permanent Red 4R, Watching Red Calcium salt, Brilliant Carmine 3B, Fast Violet B, Methyl Violet Lake, Berlin Blue, Cobalt Blue, Alkali Blue Lake, Victoria Blue Lake, quinacridone, Rhodamine B, Phthalocyanine Blue, Fast Sky Blue, Pigment Green B, Malachite Green Lake and Final Yellow Green G.

When the toners are obtained by polymerization in the present invention, attention should be paid to the inhibition against polymerization and transfer-ability into the aqueous phase of a coloring agent, and it is preferable to subject a coloring material to a surface modification, for example, a hydrophobic treatment with a material incapable of inhibiting the polymerization.

Wax for use in the present invention includes, for example, paraffin wax, polyolefin wax and their modified ones, such as oxides and grafted ones, higher fatty acids and their metal salts, and amide wax, but is not limited thereto. Particularly, paraffin wax is preferable from the viewpoint of solidification speed by temperature decrease after the fixing.

In the present invention, the wax for use in the toner particles has a melting point of preferably 30° to 150° C., more preferably 40° to 140° C. Below 30° C., the blocking resistance and shape retainability of toners are not satisfactory, whereas above 150° C. no satisfactory releasing effect can be obtained. In the present invention, the melting point is calculated from the maximum endothermic peak temperature by DSC. The wax for use in the present invention has a melt heat quantity $\Delta H$ of preferably 50 to 250 J/g.

Such wax is used in an amount of 0.1 to 50 parts by weight, preferably 1 to 45 parts by weight, more preferably 5 to 40 parts by weight per 100 parts by weight of the polymerizable monomer. Below 0.1 part by weight, the releasing effect is not remarkable, whereas above 50 parts by weight the production stability is lowered, and the blocking resistance and preservation stability are liable to decrease.

An appropriate polymerization initiator is used in the present invention, and includes, for example, azo and diazo polymerization initiators such as 2,2'-azobis-(2,4-dimethylvaleronitrile), 2,2'-azobisisobutyronitrile, 1,1'-azobis(cyclohexane-1 -carbonitrile), 2,2'-azobis-4-methoxy-2,4-dimethylvaleronitrile and azobisisobutyronitrile and peroxide polymerization initiators such as benzoyl peroxide, methylethylketone peroxide, diisopropyl peroxycarbonate, cumene hydroperoxide, 2,4-dichlorobenzoyl peroxide and lauroyl peroxide. The peroxide mentioned above as a redox initiator can be combined with such a reducing agent as dimethyl-aniline, mercaptants, tertiary amines, ferrous (II) salts, or sodium hydrogen sulfite. The polymerization initiator is preferably used to obtain a desired molecular weight. Usually, it is satisfactory to add 0.1 to 10% by weight of a polymerization initiator on the basis of the polymerizable monomer.

Releasing agent, polymerization initiator and polymerization temperature for use in the present invention will be further explained below.

When paraffin wax having a low melting point or softening point is used as a releasing agent, a temperature at which the releasing agent is precipitated from the polymerizable monomer system is usually lowered, and consequently the polymerization temperature will be also lowered. In that case, it is preferable to use a redox initiator or such an initiator having a short half-life as 2,2'-azobis-4-methoxy-2,4-dimethylvaleronitrile.

When polyolefin wax having a high melting point or softening point is used as a releasing agent, it is preferable to use an autoclave for dissolving or melting the releasing agent into the polymerizable monomer system. In that case, the precipitation temperature of the releasing agent is higher than in case of paraffin wax, and thus it is preferable to use such a polymerizable initiator as 2,2'-azobis(2,4-dimethylvaleronitrile) and dimethyl 2,2'-azobisisobutyrate.

Various additives can be added to the present toners to give various specific characteristics thereto. It is preferable from the viewpoints of durability when added to the toners that additives have particle sizes of less than 1/10 as small as the volume average diameter of toner particles. The particle sizes of the additives means an average particle size obtained by surface observation of toner particles by an electron microscope.

The additives for giving the characteristics to the toners include such ones as given below:

1) Flowability-giving agent: metal oxides (silicon oxide, aluminum oxide, titanium oxide, carbon black and carbon fluoride). It is preferable to subject these materials to a hydrophobic treatment.
2) Abrasive: metal oxides (strontium titanate, cerium oxide, aluminum oxide, magnesium oxide and chromium oxide), nitrides (silicon nitride), carbides (silicon carbide) and metal salts (calcium sulfate, barium sulfate and calcium carbonate).
3) Lubricant: fluorocarbon resin powder (polyvinylidene fluoride and polytetrafluoroethylene) and metal salts of fatty acids (zinc stearate and calcium stearate).
4) Charge-controlling particles: metal oxides (tin oxide, titanium oxide, zinc oxide, silicon oxide and aluminum oxide) and carbon black.

These additives may be used in an amount of preferably 0.1 to 10 parts by weight, more preferably 0.1 to 5 parts by weight, per 100 parts by weight of toner particles. These additives can be used alone or in mixture thereof.

It is preferable from the viewpoint of color mixability and meltability at the formation of color toner image that weight-average molecular weight (Mw) of toluene-soluble matters of particles for use in the present invention, directly obtained by suspension polymerization is 5,000 to 80,000, preferably 8,000 to 40,000, and number-average molecular weight (Mn) thereof is 1,000 to 20,000, preferably 2,000 to 15,000, and Mw/Mn is less than 20, preferably 2.0 to 10.0.

Procedure for determining the molecular weight of color toners of the present invention will be described below:

Molecular weight distribution on a chromatogram by GPC, using THF (tetrahydrofuran) as a solvent for the toluene-soluble matters of the present toner particles is determined under the following conditions:

A column is stabilized in a heat chamber at 40° C., and THF is passed as a solvent through the column at that temperature at a flow rate of 1 ml/minute, and about 100 μl of a sample solution in THF is injected thereto for the determination. In the determination of molecular weight of the sample, molecular weight distribution possessed by the sample is calculated from a correlation between the logarithmic values and count number of calibration curves prepared from several single distribution polystyrene standard samples. Standard polystyrene samples for preparing the calibration curves are those having a molecular weight of about $10^2$ to about $10^7$, made by Toso K.K or Showa Denko K.K. Japan, and it is appropriate to use at least about 10 standard polystyrene samples. As a detector, a RI (refractive index) detector is used. As a column, a plurality of commercially available polystyrene gel columns are preferably used in combination. For example, a combination of Shodex GPC KF-801, 802, 803, 804, 805, 806, 807 and 800P, made by Showa Denko K.K., Japan or a combination of TSK gel G1000H($H_{XL}$), G2000H($H_{XL}$), G3000H($H_{XL}$), G4000H ($H_{XL}$), G5000H($H_{XL}$), G6000H($H_{XL}$), G7000H($H_{XL}$) and TSK guard column, made by Toso K.K., Japan can be used.

Samples are prepared in the following manner.

Soxhlet extracts of toner particles by toluene are placed into THF and left standing for a few hours, and then thoroughly shaked and mixed with THF until coagulates of samples disappear, and the mixture is further left standing for at least 12 hours. In that case the time for standing in THF must be at least 24 hours. Then, the mixture is passed through a sample-treating filter (pore size: 0.45 to 0.5 μm). For example, Maisyori Disk H-25-5, made by Toso K.K., Japan or Ekikuro Disk 25CR, made by Gelman Science, Japan, can be utilized for this purpose. The filtrates are samples for GPC. Sample concentration is adjusted to 0.5 to 5 mg/ml.

Both-side, full color image-forming process according to the present invention will be explained below:

FIG. 1 shows an image-forming apparatus for forming a both-side, full color image according to the present image-forming method.

A color electrophotographic apparatus as shown in FIG. 1 is largely divided into a transfer material conveyer system I provided from the right side of the apparatus proper 1 (right side of FIG. 1) over approximately to the center part of the apparatus proper 1, a latent image-forming section II provided in close proximity to a transfer drum 15 constituting the transfer material conveyer system I and a developing means provided in close proximity to the latent image-forming section II, that is, a rotary developing unit III.

The transfer material conveyer system I is in the following structure. Openings are formed on the right wall of the apparatus proper 1 (right side of FIG. 1), and detachable transfer material feed trays 2 and 3 are provided into the openings, respectively, while being projected outwardly from the apparatus. Paper feed rollers 4 and 5 are provided just above the trays 2 and 3, respectively, and paper feed rollers 6 and paper feed guides 7 and 8 are provided so as to communicate the paper feed rollers 4 and 5 with a transfer drum 15, i.e. a transfer means rotatable in the direction of arrow A, provided on the left side. A contact roller 9, a gripper 10, a transfer material-separating charger 11 and a separator knife 12 are successively provided in close proximity to the outer peripheral surface of the transfer drum 15 from the upstream side toward the downstream side in the rotating direction. A transfer charger 13 and a transfer material-separating charger 14 are provided in close proximity to the inner peripheral surface of the transfer drum 15. A transfer sheet formed from polyvinylidene fluoride (not shown in the drawing) is pasted onto the part, around which a transfer material is wound, of the transfer drum 15, and the transfer material is electrostatically closely pasted onto the transfer sheet. A conveyer belt means 16 is provided in close proximity to the separator knife 12 and above the right side of the transfer drum 15, and a fixing unit 180 is provided at the right end of the conveyer belt means 16 in the transfer material conveying direction. A detachable discharge tray 17 is provided through paper discharge rollers 52 on a further downstream side in the conveying direction from the fixing unit 180 and at the apparatus proper 1, while being projected outwardly from the apparatus proper 1.

Paper refeed rollers 50 are provided below the paper discharge rollers 52 to feed again the transfer material once placed on the paper discharge tray 17 to the latent image forming section II, and a conveyer passage 51 is provided behind the paper refeed rollers 50 to convey the transfer material.

The structure of the latent image-forming section II will be explained below. A photosensitive drum 19 as a latent image carrier rotatable in the direction of arrow B in FIG. 1 is provided in contact with the outer peripheral surface of the transfer drum 15. A deelectrifying charger 20, a cleaning means 21 and a primary electrostatic charger 23 are successively provided above the photosensitive drum 19 and in close proximity to the outer peripheral surface thereof from the upstream side toward the downstream side in the rotating direction of the photosensitive drum 19, and an image light exposure means 24 such as a laser beam scanner and an image light exposure-reflecting means 25 such as a mirror are provided to form an electrostatic latent image on the outer peripheral surface of the photosensitive drum 19.

The structure of the rotary developing unit III will be explained below. A rotatable box 26, which will be hereinafter referred to as a rotor, is provided at a position opposite to the outer peripheral surface of the photosensitive drum 19, and 4 developing units are loaded at 4 positions in the peripheral direction in the rotor 26 to visualize the electrostatic latent image formed on the outer peripheral surface of the photosensitive drum 19, that is, to develop the latent image. The 4 developing units are a yellow developing unit 27Y, a magenta developing unit 27M, a cyan developing unit 27C and a black developing unit 27BK, respectively.

Sequence of the entire image-forming apparatus in the above-mentioned structure will be simply explained below, referring to a case of full color mode as an example. When the photosensitive drum 19 rotates in the direction of arrow B in FIG. 1, the photosensitive member on the photosensitive drum 19 is uniformly electrostatically charged by the primary electrostatic charger 23. In the apparatus of FIG. 1, the moving speeds of the respective parts (which will be hereinafter referred to as "process speeds") are uniformly 160 mm/sec. After the uniform electrostatic charging by the primary electrostatic charger 23, image light exposure is carried out by a laser beam E modulated by yellow image signals of original 28 and an electrostatic image is formed on the photosensitive drum 19. The electrostatic image is developed by the yellow developing unit 27Y located at the developing position in advance through rotation of the rotor 26.

Transfer material conveyed through the paper feed guide 7, the paper feed roller 6 and the paper feed guide 8 is held by the gripper 10 at a predetermined timing and electrostatically wound around the transfer drum 15 by the contact roller 9 and an electrode provided opposite to the contact roller 9. The transfer drum 15 rotates in the direction of arrow A in FIG. 1 in a manner synchronized with the photosensitive drum 19, and the image developed and visualized by the yellow developing unit 27Y is transferred at the contact site of the outer peripheral surface of the photosensitive drum 19 with the outer peripheral surface of the transfer drum 15 by the transfer charger 13. The transfer drum continuously rotates as such to make ready for the transfer of successive color (magenta in FIG. 1).

The photosensitive drum 19 is deelectrified by the deelectrifying charger 20, cleaned by the cleaning means 21 based on a known blade cleaning, then again electrostatically charged by the primary electrostatic charger 23 and subjected to an image light exposure of next magenta image signals in the same manner as above. The rotary developing unit is rotated during the formation of an electrostatic image by magenta image signals on the photosensitive drum 19 through the image light exposure, thereby locating the magenta developing unit 27 to the above-mentioned predetermined developing position to conduct the desired development. Successively, the similar processes are carried out for cyan color and black color. After completion of the transfer of 4 colors, the visualized image of 4 colors on the transfer material is deelectrified by the respective chargers 20 and 14, and the transfer material is then released from holding by the gripper 10, separated from the transfer drum 15 by the separator knife 12, sent to the fixing unit 180 by the conveyer belt 16 and subjected to fixing under actions of heat and pressure and led to the paper discharge tray 17 by the paper discharge rollers 52. Then, the transfer material is again fed by the paper refeed rollers 50 to the latent image-forming section II through the conveyer passage 51 to form a color image on the back side likewise. The transfer material having a color image already fixed on the surface side and carrying an unfixed color toner image transferred onto the back side is conveyed to the fixing roller 29 and the pressing roller 30 by the conveyer belt means 16, and fixed and ultimately conveyed onto the paper discharge tray 17 to complete both-side color copying.

The fixing speed of the fixing unit 180 is 90 mm/sec which is lower than the process speed of the apparatus proper, that is, 160 mm/sec, because in case of melting and color mixing of the unfixed image of toners laid in two layer to four layers, a sufficient quantity of heat must be given to the toners, as will be explained later, and the quantity of heat to the toners can be increased by conducting the fixing at a lower speed than that for the apparatus proper.

Figure 2:
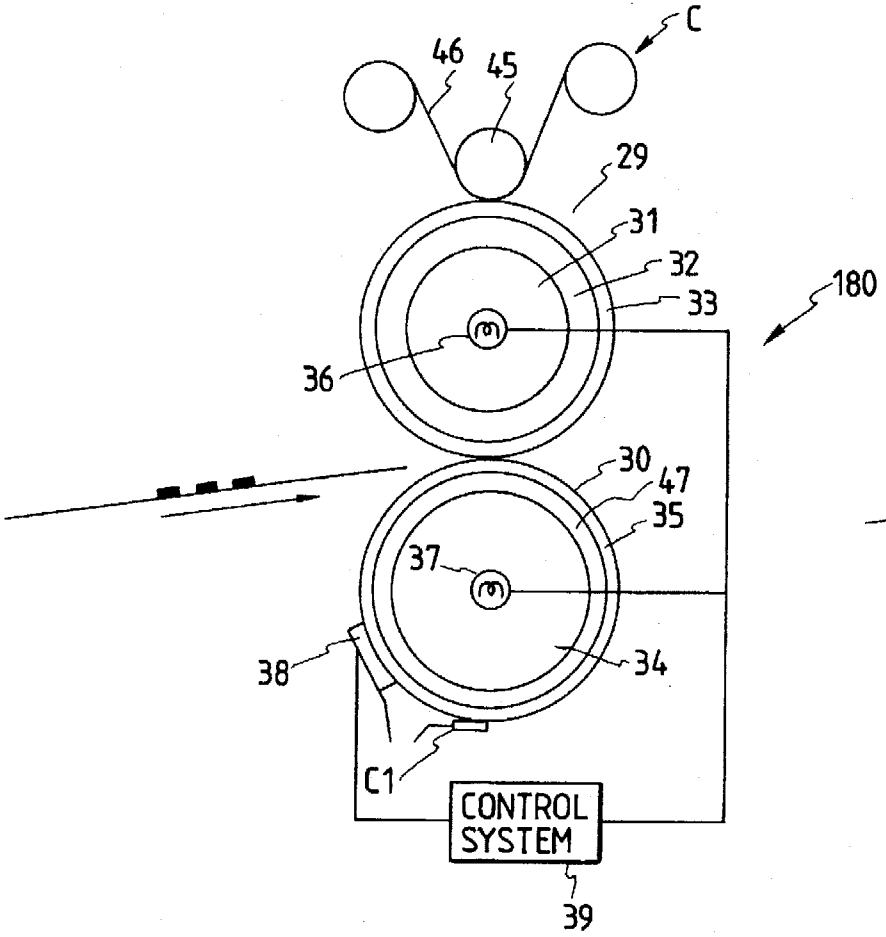
FIG. 2 is a schematic view showing the structure of the fixing unit of FIG. 1.
Figure 3:
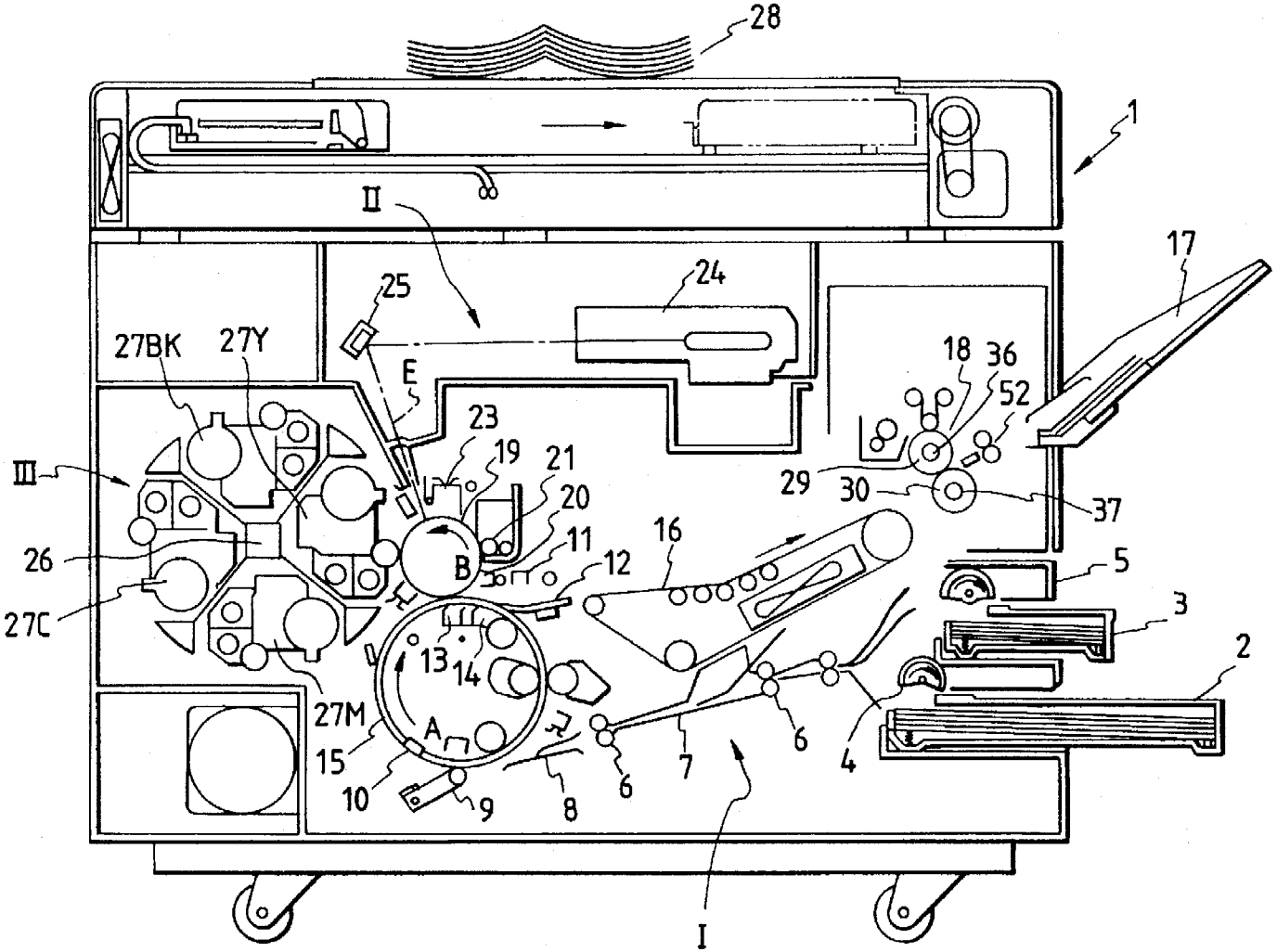
FIG. 3 is a schematic view of the structure of a conventional image-forming apparatus for forming the ordinary full color image.

FIG. 2 is a view showing the structure of the fixing unit 180 in detail.

In FIG. 2, the fixing roller 29 as a fixing means comprises, for example, an aluminum core 31, a silicone rubber layer 32 of HTV (high temperature vulcanization type) laid thereon, and a silicone rubber layer 33 of RTV (room temperature vulcanization type) laid thereon, 3 mm in total layer thickness and 60 mm in diameter. The pressing roller 30 as a pressing means comprises, for example, an aluminum core 34, a silicone rubber layer 47 of HTV type having a thickness of 1 mm thereon and a silicone rubber layer 35 of RTV type thereon, 60 mm in diameter.

A halogen heater 36 is provided as a heating means in the fixing roller 29 and also a halogen heater 37 is likewise provided in the core of the pressing roller 30 to conduct heating to both sides. Temperature of the pressing roller is detected by a thermister 38 in contact with the pressing roller 30, and the halogen heaters 36 and 37 are controlled by a control system or controller 39 on the basis of the detected temperature. That is, the temperatures of the fixing roller 29 and the pressing roller 30 are both controlled constantly to about 170° C. The fixing roller 29 and the pressing roller 30 are pressed under a total pressure of about 40 kg by a pressing mechanism (not shown in the drawing). The cleaning unit C is to conduct cleaning by pressing a web 46 of non-woven fabric made from Nomex (trademark, supplied by E. I. du Pont de Nemours & Co.) onto the fixing roller 29 by the pressing roller 45. The web 46 is properly wound up by a winder (not shown in the drawing) to avoid accumulation of toners at the contact part.

In the present invention, the wax contained in the toners acts as a releasing agent as to the offsetting of toners during the fixing, and thus it is most preferable to conduct the fixing in an oil-free state as shown in the fixing unit of FIG. 2. If necessary, the web 46 can be impregnated with oil such as dimethylsilicone oil and the fixing can be carried out while applying the oil to the transfer material at 0.04 mg/A4 or less, preferably 0.02 mg/A4 or less (application dosage onto the entire surface of a transfer material having an A4 size).

In the present invention, color toners for forming a color toner image contain toner particles directly obtained by suspension polymerization and also the toner particles contain wax. Thus, in case of forming color toner images fixed on both sides of a transfer material, a good offsett resistance can be obtained without using oil in the fixing means during the fixing or by using a smaller amount of oil, and both-side color toner images can be obtained while preventing or suppressing image deteriorations due to the transporation of the oil on the surface of a latent image carrier.

The present invention will be explained in detail below, referring to Examples, by which the present invention will not be limited. In Examples, "part" and "%" are by weight, unless otherwise specially mentioned.

EXAMPLE 1

451 parts of an aqueous 0.1M $Na_3PO_4$ solution was added to 709 parts of deionized water and heated to 60° C. Then, the mixture was stirred at 12,000 rpm by TK type homomixer (made by Tokushu Kika Kogyo K.K., Japan). Then, 67.7 parts of an aqueous 1.0M $CaCl_2$ solution was slowly added thereto to obtain a dispersion medium containing $Ca_3(PO_4)_2$.

Among the following components:

Styrene: 170 parts
2-ethylhexyl acrylate: 30 parts
Paraffin wax (m.p.: 75° C.): 60 parts
C.I. Pigment Blue-15:3: 10 parts
Styrene-methacrylic acid-methyl methacrylate copolymer (Mw: 50,000 and
Mw/Mn=2.2, acid value =50): 5 parts
Di-tert-butyl salicylic acid metal compound: 3 parts Only C.I. Pigment Blue 15:3, di-tert-butylsalicylic acid metal compound and styrene were premixed in an Ebara milder (made by Ebara Seisakusho K.K., Japan). Then, all the above components were heated to 60° C., and subjected to dissolution and dispersion to obtain a monomer mixture. Then, 10 parts of dimethyl 2,2'-azobisisobutyrate as a polymerization initiator was added thereto and dissolved therein, while keeping the monomer mixture at 60° C., thereby obtaining a monomer composition.

Then, the thus obtained monomer composition was added to the dispersion medium prepared in a 2-l flask of the above-mentioned homomixer. The mixture was stirred at 10,000 rpm for 20 minutes in the TK type homomixer brought into a nitrogen atmosphere at 60° C. to granulate the monomer composition. Then, the granulates were subjected to reaction at 60° C. for 3 hours while stirring the granulates with paddle stirring blades, and then to polymerization at 80° C. for 10 hours.

After the end of polymerization reaction, the reaction product was cooled, admixed with hydrochloric acid to dissolve $Ca_3(PO_4)_2$, and recovered by filtration. The recovered product was washed with water and dried, thereby obtaining polymer toners (toner particles).

The particle sizes of the thus obtained toner particles were measured by a Coulter counter, and it was found that the weight average diameter was 8.2 μm with a sharp particle size distribution. Inspection of particle cross-section by a dying, ultra thin slicing process using a transmission type, electron microscope revealed that a surface layer region comprised mainly of styrene-acrylate resin and a central region composed mainly of wax were discretely separated to form a capsule structure. It was also found that the weight average molecular weight (Mw) of toluene-soluble matters of the toner particles was 29,000, the number average molecular weight (Mn) was 8,000, and Mw/Mn was 3.6.

0.7 parts of hydrophobic silica having a BET specific surface area of 200 $m^2/g$ were added to 100 parts of the thus obtained toners to produce Cyan toners, and 93 parts of Cu-Zn-Fe ferrite carrier coated with styrene-methyl methacrylate copolymer on the surface was mixed into 7 parts of the thus obtained Cyan toner to produce a blue developing agent.

With the thus obtained blue developing agent an image was developed under such developing conditions as a developing contrast of 320 V in an atmosphere of 23° C./65%, in an image-forming apparatus as shown in FIG. 1, which was so remodelled from a commercial available color copier (CLC-500, a product made by Canon K.K., Japan) as to enable both-side copying.

The fixing roller had an outer diameter of 60 mm and was comprised of an aluminum core, a phenyl HTV silicone rubber layer having a thickness of 800 μm, formed on the core, and a one-pot RTV silicone rubber layer having a thickness of 200 μm, further formed thereon as an offset-preventing layer, and had a roller effective hardness of 80° (Asker-c under a load of 1 kg). The pressing roller had an outer diameter of 60 mm and was comprised of an aluminum core and a phenyl HTV silicone rubber layer having a thickness of about 2 mm, formed on the core, coated further with a fluorocarbon resin tube having a thickness of 50 μm on the outer surface, and had a roller effective hardness of 87° (Asker-c under a load of 1 kg).

The fixing roller and the pressing roller as mentioned above were mounted on the image-forming apparatus, as shown in FIG. 1 to conduct a durability test of 5,000 sheets in a monochromic mode (single cyan color). Fixing was carried out at a fixing temperature of 170° C. and a fixing speed of 90 mm/sec without any oil application.

The thus obtained images were color images exactly reproduced according to the original chart without any offsetting at all on both surface side and back side.

The transfer sheet and the surface of the photosensitive drum were carefully inspected after the end of the durability test, and the effect of the present invention was confirmed without any wax foulings thereon.

EXAMPLE 2

Durability test of 5,000 sheets was carried out in the same manner as in Example 1, except that a fixing roller comprising an aluminum core and a phenyl HTV silicone rubber layer having a thickness of 2 mm and a piece rubber hardness of 33° (JIS-A under a load of 1 kg), coated further with a fluorocarbon resin tube having a thickness of 50 μm thereon and having a roller effective hardness of 81° (Asker-c under a load of 1 kg) was used in place of the fixing roller of Example 1.

Color images were reproduced exactly according to the original chart without any offsetting at all on both surface side and back side.

Comparative Example 1

The following components were mixed:

Styrene-2-ethylhexy acrylate copolymer: (comonomer ratio=88:12 by weight, MW=30,000 and MW/Mn =3.5): 100 parts Low molecular weight polyolefin wax (m.p.=130° C.): 2 parts C.I. Pigment Blue-15:3: 4.5 parts Di-tert-butyl salicylic acid metal compound: 3 parts and then the mixture was melted, kneaded and extruded by a biaxial kneading extruder and then cooled, pulverized by a pneumatic pulverizer, and classified by a pneumatic classifier to obtain blue powdery toners having a weight average diameter of about 8.5 μm (toner particles). It was found that Mw of toluene-soluble matters of the toner particles wand 29,500, Mn 8,000, and Mw/Mn 3.7.

Then, 0.8 parts of negatively chargeable colloidal silica were added to 100 parts of the thus obtained toners to obtain cyan toners. The thus obtained cyan toners were mixed with ferrite particles coated with fluoro-acrylic resin in a ratio of 8:92 by weight to obtain a blue developing agent.

With the thus obtained blue developing agent, a durability test was carried out in the same manner as in Example 1, but offsetting occurred soon after the start of the durability test, and thus the durability test was discontinued.

Comparative Example 2

Blue powdery toners (toner particles) were obtained in the same manner as in Comparative Example 1 except that 2 parts of paraffin wax (m.p. 75° C.) was used in place of the low molecular weight polyolefin wax of Comparative Example 1. It was found that Mw of the toluene-soluble matters of the thus obtained toners was 29,800, Mn 8,000 and Mw/Mn 3.7. A blue developing agent was obtained in the same manner as in Comparative Example 1. With the thus obtained blue developing agent, a durability test was carried out, but offsetting occurred soon after the start of the durability test, as in Comparative Example 1, and thus the durability test was discontinued.

Comparative Example 3

Figure 4:
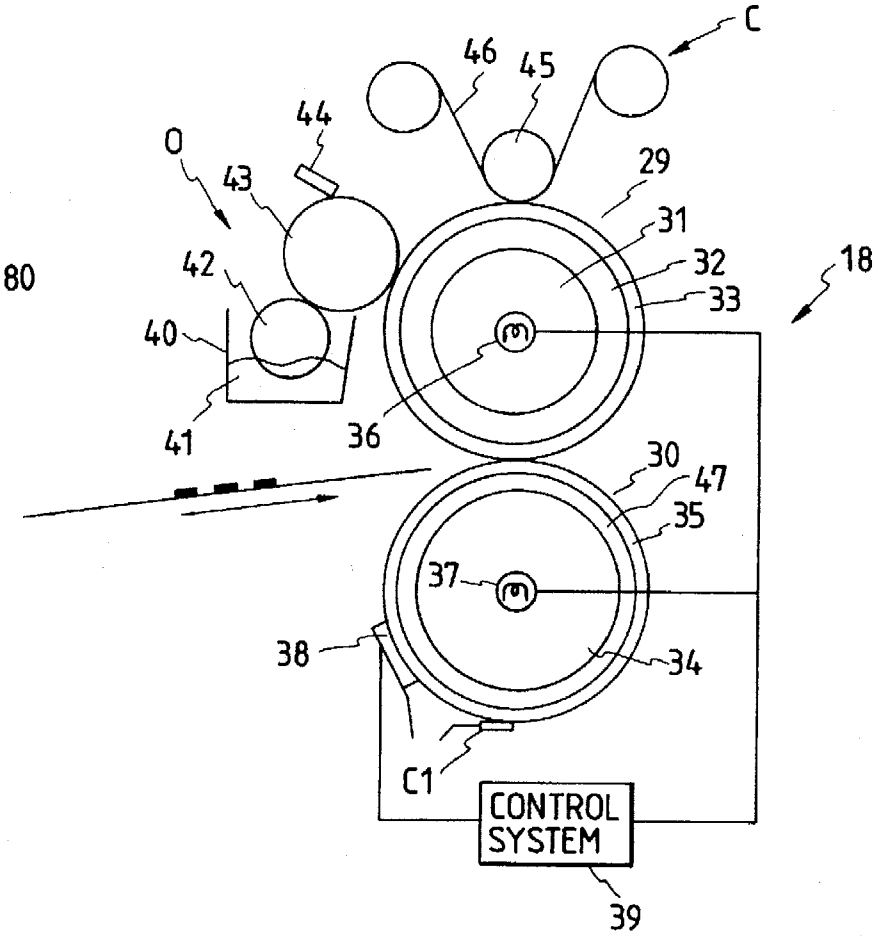
FIG. 4 is a schematic view showing the structure of the fixing unit for use in the conventional image-forming apparatus of FIG. 3.

A developing agent was prepared in the same manner as in Comparative Example 1, and a durability test was carried out while applying oil at an oil application dosage of 0.08 mg/A4 by an oil applicator as shown in FIG. 4. No offsetting occurred, but the images were considerably deteriorated in the course of the durability test.

EXAMPLE 3

A monomer composition was prepared in the same manner as in Example 1, except that 30 parts of the paraffin wax was used in place of 60 parts of Example 1, and then polymer toners (toner particles) were obtained in the same manner as in Example 1. Likewise, hydrophobic silica was mixed with the toner particles to obtain cyan toners. It was found that the weight average molecular weight (Mw) of toluene-soluble matters of the toner particles was 32,000, the number average molecular weight (Mn) 9,800 and Mw/Mn 3.3.

A blue developing agent was prepared from the thus obtained cyan toners in the same manner as in Example 1 and images were formed with the thus obtained blue developing agent. The fixing unit in the image-forming apparatus had a web made of heat-resistant fibers of aromatic polyamide, impregnated with dimethylsilicone oil, which was in contact with the surface of the fixing roller. That is, a durability test of 5,000 sheets was carried out by fixing color toner images while applying the dimethylsilicone oil to the transfer materials at an application dosage of 0.01 mg/A4. After the end of the durability test it was found that the thus obtained images were at a level of no practical problem, though there were some image defects due to foulings of the photosensitive drum with the dimethylsilicone oil.

Comparative Example 4

A blue developing agent was prepared in the same manner as in Comparative Example 1, and the web was impregnated with dimethylsilicone oil in the same manner as in Example 3. A durability test was carried out by fixing color toner images while applying dimethylsilicone oil to transfer materials at an application dosage of 0.01 mg/A4. Offsetting occurred after fixing of 500 sheets, and the test was discontinued.

EXAMPLE 4

Polymer toners (toner particles) were obtained in the same manner as in Example 1, except that 9 parts of C.I. Pigment Red 122 were used in place of C.I. Pigment Blue-15:3 of Example 1, and likewise magenta toners were obtained by mixing with hydrophobic silica.

A red developing agent was prepared from the thus obtained magenta toners in the same manner as in Example 1 and a durability test of 5,000 sheets was carried out by forming images. The thus obtained images were color images reproduced exactly according to the original chart without any offsetting on both surface side and back side.

After the end of the durability test, the surfaces of the transfer sheet and the photosensitive drum were carefully inspected and the effect of the present invention was confirmed without any substantial wax foulings.

EXAMPLE 5

Polymer toners (toner particles) were obtained in the same manner as in Example 1, except that 8 parts of C.I. Pigment Yellow 17 were used in place of C.I. Pigment Blue-15:3 of Example 1, and likewise yellow toners were obtained by mixing with hydrophobic silica.

A yellow developing agent was prepared from the thus obtained yellow toners in the same manner as in Example 1 and a durability test of 5,000 sheets was carried out by forming images. The thus obtained images were color images reproduced exactly according to the original chart without any offsetting on both surface side and back side.

After the end of the durability test, the surfaces of the transfer sheet and the photosensitive drum were carefully inspected and the effect of the present invention was confirmed without any substantial wax foulings.

EXAMPLE 6

Polymer toners (toner particles) were obtained in the same manner as in Example 1, except that 12 parts of commercially available carbon black were used in place of C.I. Pigment Blue-15:3 of Example 1, and likewise black toners were obtained by mixing with hydrophobic silica.

A black developing agent was prepared from the thus obtained black toners in the same manner as in Example 1 and a durability test of 5,000 sheets was carried out by forming images. The thus obtained images were color images reproduced exactly according to the original chart without any offsetting on both surface side and back side.

After the end of the durability test, the surfaces of the transfer sheet and the photosensitive drum were carefully inspected and the effect of the present invention was confirmed without any substantial wax fouling.

EXAMPLE 7

Color toner images based on 4 kinds of color toners were transferred onto transfer materials with the blue developing agent used in Example 1, the red developing agent used in Example 4, the yellow developing agent used in Example 5 and the black developing agent used in Example 6, and a durability test was carried out by forming images under the same conditions as in Example 1, except that the color toner images were fixed onto the transfer materials by the fixing roller used in Example 2. Even after the durability test of 3,000 sheets, no offsetting was observed at all and full color images were reproduced on both sides of each of the transfer materials exactly according to the original chart.

What is claimed is:

1. An image-forming method comprising the steps of:

(i) transferring a first color toner image comprised of color toner particles formed on an image carrier onto a first surface of a transfer material having said first surface and a second surface opposite said first surface, the color toner particles having a capsule structure which comprises wax having a melting point of 40° C. to 140° C. contained inside of each color toner particle and a surface layer region comprised of a resin, wherein said wax is present in the core of said capsule to allow exudation of the wax to the capsule surface upon application of heat and pressure;

(ii) a first fixing step of fixing the first color toner image on the first surface of the transfer material by a fixing means for applying both heat and pressure onto the first surface of the transfer material and the second surface of the transfer material through heating and melting, thereby obtaining a first color image and thereby melting the wax from the color toner particles of the first color toner image, the melted wax covering at least a part of the surface of the first color image to prevent toner offset and thereafter solidifying as a result of temperature decrease after passing through said fixing means, said first fixing step being performed while applying oil to the transfer material at an application dosage of between 0.00 and 0.04 mg/A4 at said fixing means, wherein the fixing means has a fixing side and a nonfixing side and is provided with heating means at both the fixing side and the nonfixing side;

(iii) transferring a second color toner image comprised of said color toner particles formed on the image carrier onto the second surface of the transfer material, wherein said wax is present in the core of said capsule to allow exudation of the wax to the capsule surface upon application of heat and pressure; and (iv) a second fixing step of fixing the second color toner image on the second surface of the transfer material by the fixing means through heating and melting, thereby obtaining a second color image on the second surface of the transfer material, and thereby melting the wax from the color toner particles of the second color toner image, the melted wax covering at least a part of the second color image to prevent toner offset and thereafter solidifying as a result of temperature decrease after passing through said fixing means, said second fixing step being performed while applying oil to the transfer material at an application dosage of between 0.00 and 0.04 mg/A4 at said fixing means;

wherein the wax covering at least a part of the surface of the first color image melts by the fixing means in the second fixing step to prevent offset during said second fixing step and thereafter solidifies as a result of temperature decrease after passing through said fixing means.

2. A method according to claim 1, wherein said first fixing step comprises the step of fixing the first color toner image on the first surface of the transfer material, wherein wax melted from color toner particles covers the entire surface of the first color image in the first fixing step.

3. A method according to claim 1, wherein said first fixing step comprises the step of fixing the first color toner image on the first surface of the transfer material, wherein wax melted from the color toner particles covers only part of the surface of the first color image in the first fixing step.

4. A method according to claim 1, wherein said first color toner image comprises a plurality of different color toners.

5. A method according to claim 1, wherein said second color toner image comprises a plurality of different color toners.

6. A method according to claim 1, wherein said first and second color toner images each comprise a plurality of different color toner particles.

7. A method according to claim 1, wherein the color toner particles of the first and second color toner images are obtained by polymerization of a monomer composition comprising a polymerizable monomer, a coloring agent, and a wax.

8. A method according to claim 7, wherein the color toner particles of the first and second color toner images contain 0.1 to 50 parts by weight of the wax per 100 parts by weight of the polymerizable monomer.

9. A method according to claim 7, wherein the color toner particles of the first and second color toner images contain 1 to 45 parts by weight of the wax per 100 parts by weight of the polymerizable monomer.

10. A method according to claim 7, wherein the color toner particles of the first and second color toner images contain 5 to 40 parts by weight of the wax per 100 parts by weight of the polymerizable monomer.

11. A method according to claim 1, wherein the color toner particles of the first and second color toner images contain at least one wax selected from the group consisting of paraffin wax, polyolefin wax, modified polyolefin wax, higher fatty acids, metal salts of higher fatty acids, and amide wax.

12. A method according to claim 1, wherein said color toner particles containing wax having a melt heat quantity, $\Delta H$, of 50 to 250 J/g.

13. A method according to claim 1, wherein the color toner particles of the first and second color toner images comprise color toners, each of the color toners containing additives, each of the additives having a particle size of less than 1/10 of an average diameter of the respective color toner particles of the first and second color toner images.

14. A method according to claim 1, wherein the color toner particles of the first and second color toner images comprise color toners, each of the color toners containing at least one additive selected from the group consisting of a flowability-giving agent, an abrasive, a lubricant, and charge-controlling particles.

15. A method according to claim 1, wherein the color toner particles of the first and second color toner images comprise color toners, each of the color toners containing 0.1 to 10 parts by weight of an additive per 100 parts by weight of the respective color toner particles of the first and second color toner images.

16. A method according to claim 1, wherein the color toner particles of the first and second color toner images comprise color toners, each of the color toners containing 0.1 to 5 parts by weight of an additive per 100 parts by weight of the respective color toner particles of the first and second color toner images.

17. A method according to claim 1, wherein the color toner particles of the first and second color toner images have a weight average molecular weight, Mw, of 5,000 to 80,000, a number average molecular weight, Mn, of 1,000 to 20,000, and wherein Mw/Mn is less than 20 with respect to toluene-soluble matters of the color toner particles of the first and second color toner images.

18. A method according to claim 1, wherein the color toner particles of the first and second color toner images have a weight average molecular weight, Mw, of 5,000 to 40,000, a number average molecular weight, Mn, of 2,000 to 15,000, and wherein Mw/Mn is within a range of 2.0 to 10.0 with respect to toluene-soluble matters of the color toner particles of the first and second color toner images.

19. A method according to claim 1, wherein the oil is applied to the transfer material at an application dosage of between 0.0 and 0.02 mg/A4.

20. A method according to claim 1, wherein said first color toner image comprises a combination of at least two kinds of color toner particles selected from the group consisting of yellow toner particles, magenta toner particles, cyan toner particles, and black toner particles.

21. A method according to claim 1, wherein said second color toner image comprises a combination of at least two kinds of color toner particles selected from the group consisting of yellow toner particles, magenta toner particles, cyan toner particles, and black toner particles.

22. A method according to claim 1, wherein said first and second fixing steps further comprise the step of controlling the temperature of the heating means of the fixing and nonfixing sides.

23. A method according to claim 22, wherein the heating means at the fixing side and the nonfixing side of the fixing means are each independently controlled with respect to temperature.

24. A method according to claim 22, wherein a temperature of only the nonfixing side of the fixing means is detected by a temperature detector, and the heating means at both the fixing side and the nonfixing side of the fixing means are each controlled based on the temperature of the nonfixing side of the fixing means detected by the temperature detector.

25. A method according to claim 1, wherein said first fixing step and said second fixing step are performed without adding said oil as a releasing agent.

26. A method according to claim 1, wherein a temperature of only the nonfixing side of the fixing means is detected by a temperature detector, and the heating means at both the fixing side and the nonfixing side of the fixing means are each controlled based on the temperature of the nonfixing side of the fixing means detected by the temperature detector.

27. A method according to claim 1, wherein the color toner particles of the first and second color toner images are obtained by suspension polymerization of a monomer composition in an aqueous phase containing a dispersion stabilizer, the monomer composition comprising a polymerizable monomer, a coloring agent, and a wax.

28. A method according to claim 1, wherein the color toner particles of the first and second color toner images contain paraffin wax.

29. A method according to claim 1, wherein both of said first and second color toner images comprise a combination of at least two kinds of color toner particles selected from the group consisting of yellow toner particles, magenta toner particles, cyan toner particles, and black toner particles.

30. A method according to claim 1, wherein said oil is applied to the transfer material at an application dosage of no more than 0.04 mg/A4.

* * * * *

UNITED STATES PATENT AND TRADEMARK OFFICE

CERTIFICATE OF CORRECTION

PATENT NO. : 5,672,452

DATED : September 30, 1997

INVENTOR(S) : MAKOTO KANBAYASHI ET AL.

It is certified that error appears in the above-identified patent and that said Letters Patent is hereby corrected as shown below:

TITLE PAGE AT [30]

Foreign Application Priority Data, "5-178900" should read --4-178900--.

COLUMN 1

Line 49, "is" should read --are--.

COLUMN 3

Line 55, "unit 27" should read --unit 27M--.

COLUMN 4

Line 64, "both side" should read --both-side--.

COLUMN 5

Line 30, "an other" should read --another--;

COLUMN 5

Line 31, "an other" should read --another--.

COLUMN 6

Line 7, "so" should read --so---;
Line 10, "can be never" should read --cannot be--;
Line 45, "drum, such" should read --drum. Such--.

COLUMN 8

Line 67, "Navel" should read --Naval--.

COLUMN 9

Line 10, "transfer-ability" should read --transferability--.

UNITED STATES PATENT AND TRADEMARK OFFICE

CERTIFICATE OF CORRECTION

PATENT NO. : 5,672,452

DATED : September 30, 1997

INVENTOR(S) : MAKOTO KANBAYASHI ET AL.

It is certified that error appears in the above-identified patent and that said Letters Patent is hereby corrected as shown below:

COLUMN 12
Line 66, "unit 27" should read --unit 27M--.

COLUMN 13
Line 22, "layer" should read --layers--.

COLUMN 14
Line 3, "offsett" should read --offset--;
Line 33, "milder" should read --mixer--.

COLUMN 16
Line 2, "wand" should read --was--.

COLUMN 18
Line 60, "step" should read --step,--
Line 66, "color" should read --the color--.

UNITED STATES PATENT AND TRADEMARK OFFICE

CERTIFICATE OF CORRECTION

PATENT NO. : 5,672,452

DATED : September 30, 1997

INVENTOR(S) : MAKOTO KANBAYASHI ET AL.

It is certified that error appears in the above-identified patent and that said Letters Patent is hereby corrected as shown below:

COLUMN 19

Line 38, "having" should read --have--.

Signed and Sealed this

Fourteenth Day of April, 1998

Bruce Lehman

*Attest:*

BRUCE LEHMAN

*Attesting Officer*

*Commissioner of Patents and Trademarks*